US005993335A

United States Patent [19]

Eden et al.

[11] Patent Number: 5,993,335

[45] Date of Patent: Nov. 30, 1999

[54] ROLLERCROSS-TYPE GAME AND METHOD THEREOF

[75] Inventors: Robert Eden, Palm Springs; Tim Lowry, Burbank, both of Calif.

[73] Assignee: Eden Enterprises, Palm Springs, Calif.

[21] Appl. No.: 09/112,476

[22] Filed: Jul. 9, 1998

Related U.S. Application Data

[60] Provisional application No. 60/075,431, Feb. 20, 1998.

[51] Int. Cl.[6] ..... A63B 67/00

[52] U.S. Cl. ..... 473/471; 472/89; 472/92

[58] Field of Search ..... 473/415, 465, 473/470, 471, 473, 474, 513; 472/88, 89, 90, 92, 94, 136

[56] References Cited

U.S. PATENT DOCUMENTS

| | | | |
|---|---|---|---|
| 594,331 | 11/1897 | Crossley | 472/89 |
| 1,091,484 | 3/1914 | Cohn | 472/89 |
| 4,883,267 | 11/1989 | Burley | 472/90 |
| 5,494,297 | 2/1996 | MacNeil | 473/513 |
| 5,524,310 | 6/1996 | Farnen | 472/89 X |
| 5,906,545 | 5/1999 | Eden et al. | 472/92 |
| 5,908,360 | 6/1999 | Guillont | 473/465 X |

*Primary Examiner*—William H. Grieb
*Attorney, Agent, or Firm*—Hoffman, Wasson & Gitler

[57] ABSTRACT

A method of playing a game on a rink including a center planar playing surface surrounded by a ramped area which in turn is surrounded by an upper platform area. Two goals are provided opposite to one another on the planar playing surface. Each player utilizes a modified lacrosse stick used to manipulate a ball into the opponent's goal. Unlike, lacrosse, the ball may be rolled on the ground as in hockey, although the main movement of the ball will be airborne from net to net. Passing maneuvers are caught, carried, rolled or thrown.

10 Claims, 3 Drawing Sheets

ROLLERCROSS-TYPE GAME AND METHOD THEREOF

This application claims benefit of Provisional Application No. 60/075,431, filed Feb. 20, 1998.

BACKGROUND OF THE INVENTION

Dating back to the 15th century, American Indians played lacrosse. The game's main purpose was to settle tribal disputes and more importantly, to prepare and toughen warriors for battle. Legend has it that team selection and victories were supernaturally controlled. Equipment and players are still ritually prepared by ceremonies that resemble those practiced before departing on the warpath. Non-indians witnessing this game likened the sticks used to play the game to the "crosier", which were carried by bishops as a symbol of their office. Hence the name lacrosse. In the 1800's in Montreal, non-indians took up the game lacrosse which has since been designated as the national sport of Canada. The United States, England, Ireland, Scotland and Australia all play lacrosse and compete on the international level. Touted as the fastest game on two feet, lacrosse is considered to be an arduous test of strength and endurance.

Due to its cold winter weather, Canadians also participated greatly in the sport of ice hockey, which is considered to be the fastest game on two skates. Obviously, since ice hockey is placed on ice, it's playing time is limited to outdoor rinks or ponds in cold weather, as well as indoor rinks both in warm and cold weather. However, due to the rapid increase in popularity of ice hockey, particularly in the United States, rink time is often difficult to obtain and is limited in nature.

The invention of inline skates brought the world the ultimate cross training mechanism for ice hockey. Although conventional roller skates have been used to play a floor version of hockey, inline skates most closely simulates the moves on ice and the uncompromising maneuverability that makes ice hockey so fast and exciting. Now a viable sport in its own right, and the fastest-growing team sport in America at the present time, inline roller hockey has captured the majority of the inline market. The organizations that support the sport of inline hockey have nurtured the ranks of recreational skaters to skilled team play with future opportunities at the college level and professional sports.

Aggressive skating is one of the fastest-growing individual segments of inline skating. Freeform dance of risky "aggressive" tricks are performed on rails and ramps with ballet-like motion on inline skates. The sport is urban, extreme and artistic, exuding an attitude emulated by today's youth.

SUMMARY OF THE INVENTION

The present invention is directed to a game combining various features of inline skating and lacrosse creating a unique blend of extreme individual skills that rely on expert cohesive team play. This game requires high-speed maneuvers, fast passing and dramatic free-form vertical skills thereby creating a visually exciting experience for the spectator and thrilling and competitive play for the participant. The players use a netted stick similar to a lacrosse stick allowing a ball to be moved along at speeds exceeding that of an ice hockey puck or lacrosse ball.

The sport is played on a unique playing surface or bowl combining the half-pipe concept of inline skating with the traditional rink playing field of hockey, with the exception that the periphery of the playing field would be curved rather than straight, which is conducive to inline skating. An upper deck planer surface would be provided between the curved ramp surface and the boards which surround the playing surface of conventional roller hockey or ice hockey rinks. The main level playing area would utilize the same floor markings as roller hockey.

Other features and objects of the invention will be apparent from the following detailed description taken in conjunction with the following drawings.

DETAILED DESCRIPTION OF THE DRAWINGS

DETAILED DESCRIPTION OF THE INVENTION

Figure 1:
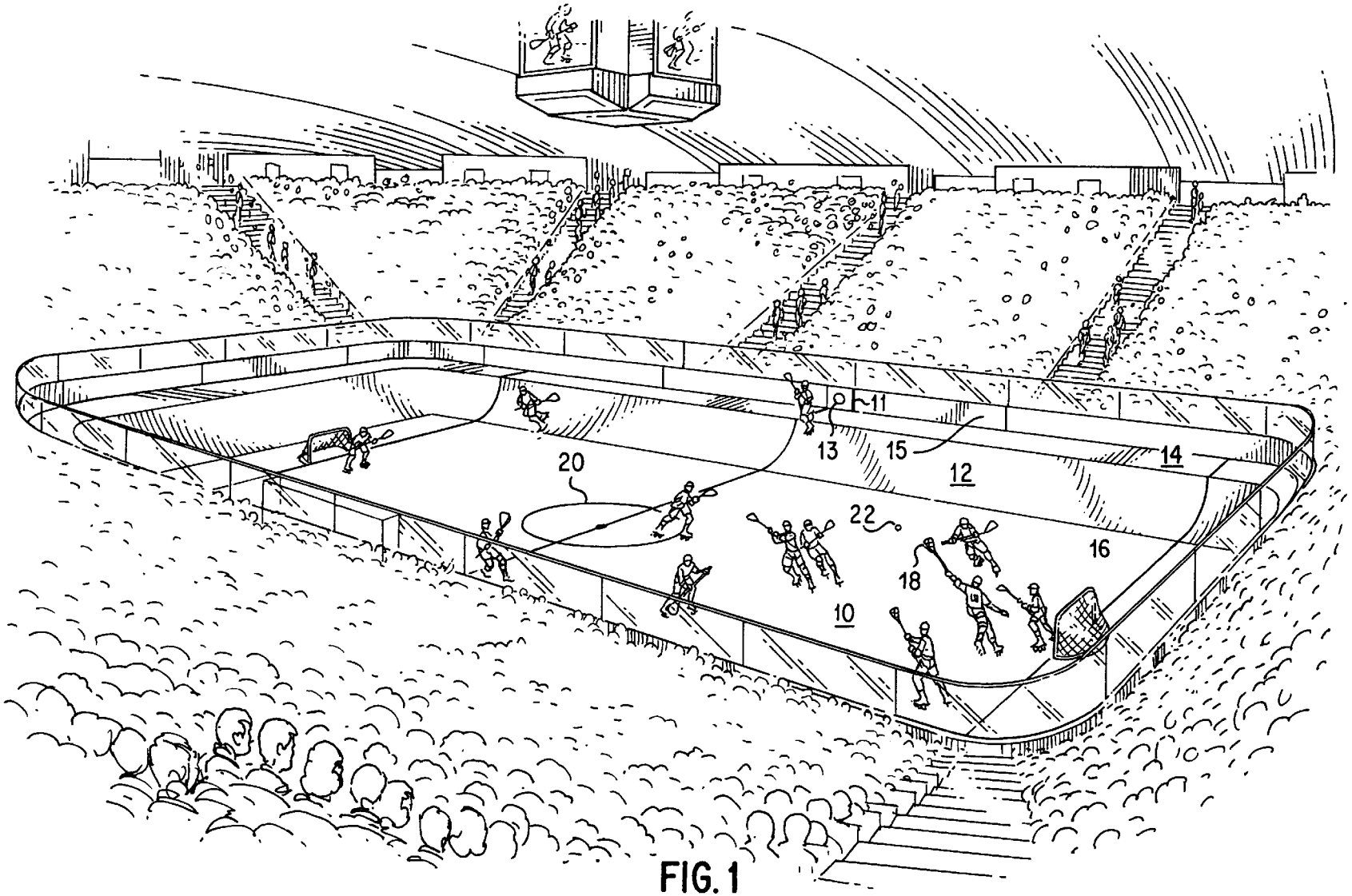
FIG. 1 is a perspective drawing of the rollercross playing surface.
Figure 2:
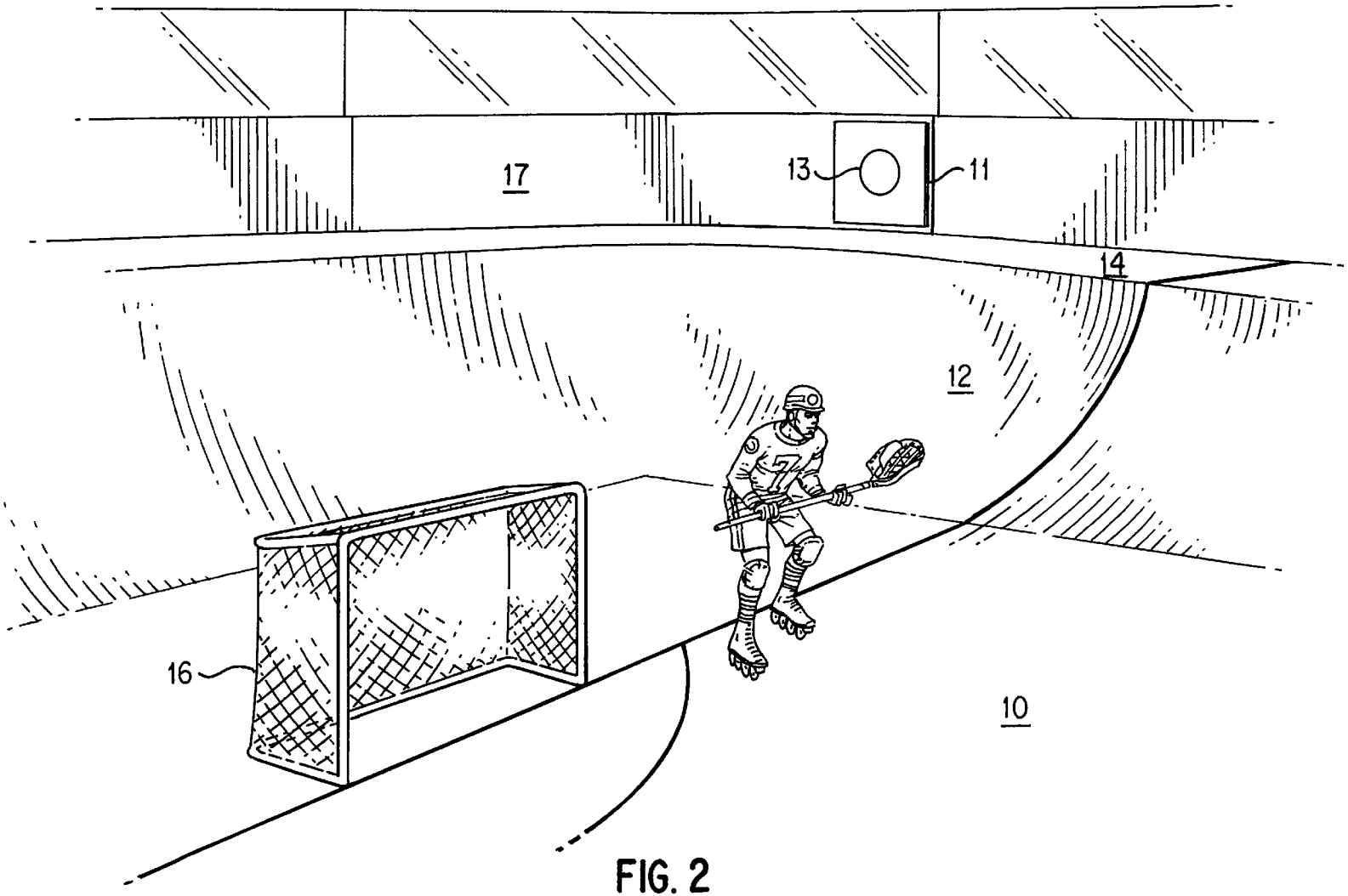
FIG. 2 is a perspective drawing of a portion of the playing surface.
Figure 3:
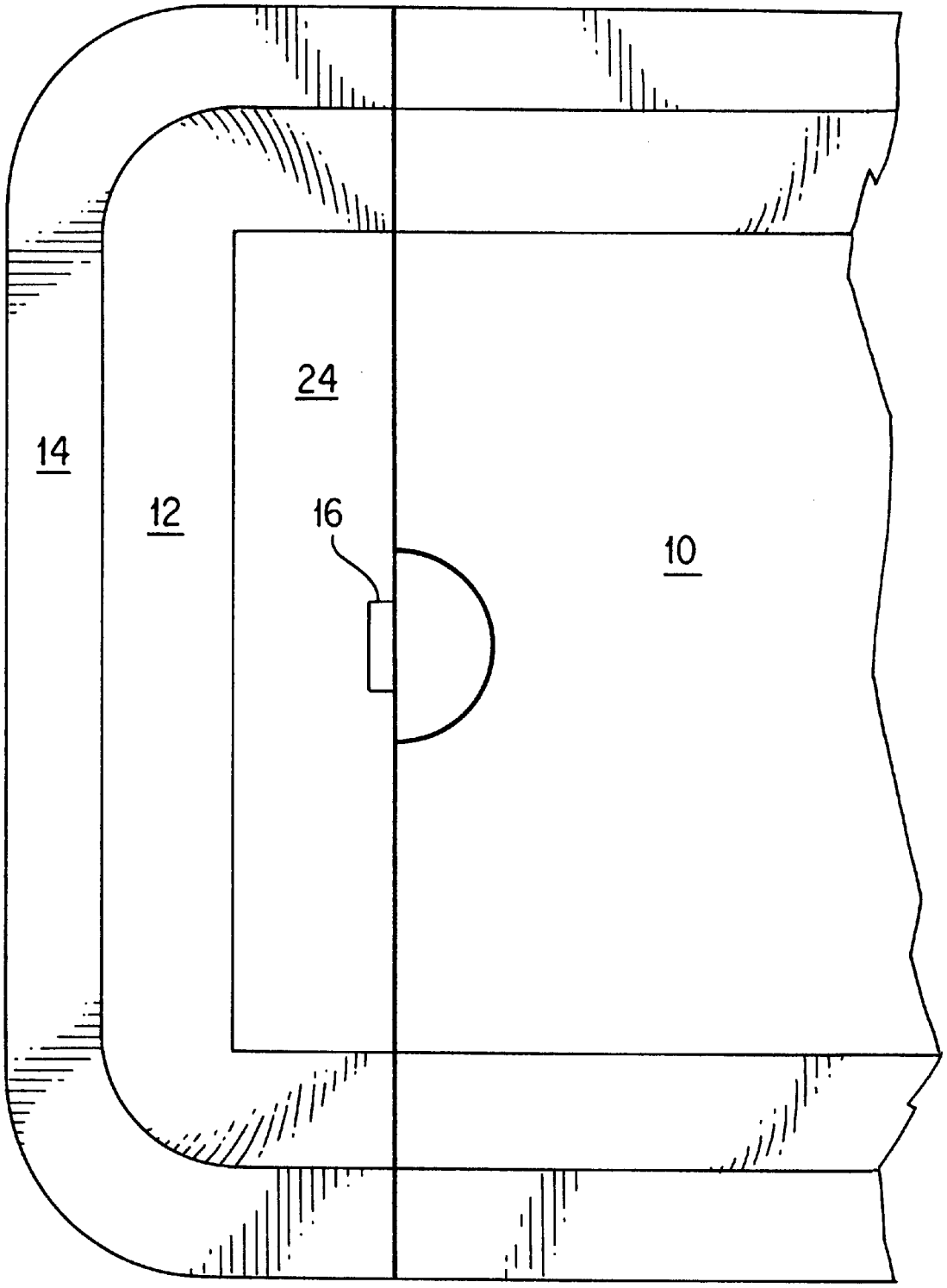
FIG. 3 is a top view showing proposed dimensions of the playing surface.

FIGS. 1–3 illustrate the rollercross rink or bowl design. The rink design includes a planer main playing area 10 extending for the majority of both the length and width of the rink. The periphery of the main rink section 10 is surrounded by a curved ramp section 12. Surrounding the curved ramp 12 is a second planer section 14. Therefore, during play, skaters would utilize the main skating surface 10, the curved ramp "half-pipe" surface 12 as well as the top planer surface 14. The playing surface would include two nets 16 and will be played with lacrosse-type sticks 18 and balls 22. A center face-off circle 20 is provided similar in nature to ice hockey, roller hockey and lacrosse. Furthermore, the main planer surface 10 includes two planer surfaces 24 provided behind each of the nets 16. The periphery of the bowl is bordered by side boards 15 and end boards 17 which generally surround the playing surface of conventional roller hockey or ice hockey rinks. The entire surface of the side walls 15 and the end walls 17 could be constructed of clear plastic, allowing the spectators to view the entire action. Alternatively, sections of the side walls 15 or end walls 17 could be constructed from a clear plastic material 11. In this instance, a camera 13 can be placed behind this clear plastic section 11.

Although the exact dimensions of the playing surface are not crucial, FIG. 3 illustrates typical dimensions. It is noted that the rollercross rink or bowl, can fit inside any regulation size ice or inline rink provided with a playing surface at a minimum of 175 feet by 65 feet or at a maximum of 200 feet by 85 feet. The ramp walls would start approximately six to eight feet from the traditional hockey boards.

The rollercross game played on the above-described playing surface will now be described. Each of the players will utilize a stick 18 similar in nature to a standard lacrosse stick. However, it is noted that variations to this stick can be made. For instance, the length of the handle of the stick as well as the type of netting would vary based upon the position played by one of the players, such as goalie, attackman or defensemen. Each of the players wears protective gear, such as helmets, gloves, shoulder, hip, pelvic, elbow and knee pads. The goal net 16 would be similar to that of hockey which is four feet tall and six feet wide. A semi-hard rubber ball is used for regulation play.

Although the rollercross rink or bowl as been described with respect to a game played by participants using inline skates, the type of surface should not be so limited. For example, when used with inline skates, the composition of the playing surface would be similar to that of an inline skating rink or a roller hockey skating rink. However, if the rink as described hereinabove were covered with ice, the players would employ ice skates. In that instance, the game could be played utilizing the same rules as well as equipment employed in ice hockey or could utilize the lacrosse sticks and ball employed in lacrosse.

Each team consists of 12 players. During play, three forwards, two defensemen, and one goalie are active in the bowl or rink area. The rules are similar to hockey. However, any intentional contact on the walls between players results on a penalty and instant removal from the game.

The game begins with a center face-off similar to lacrosse and hockey in the face-off circle 20. The objective is to manipulate the ball with the netted stick into your opponents goal to score a point. Unlike lacrosse, the ball may be rolled on the ground as in hockey, although the main movement of the ball will be airborne from net to net. Passing maneuvers are caught, carried, rolled or thrown. Line rushes, patterned offensive attacks, zone defense and man-to-man coverage similar to lacrosse and hockey are implemented. The play is constantly moving. There are no "out of bounds" and the area behind the goalie is an acceptable area of play. The game does not stop unless someone scores or a penalty occurs. Two referees man the "bowl" and severity of the penalty is at their discretion. Absolutely no checking is done on the walls and therefore contact is allowed only on the level floor portion 10. One game consists of four twelve minute quarters with teams alternating playing fields with each quarter. Two minutes are allowed between each quarter, as well as ten minutes for half time. Additionally, one time out is allowed for each team. A goal is scored when the ball is put between the goal post by the stick of a player of the attacking from in front, below the cross bar and entirely across the goal line. A goal is also scored if the ball is put into the goal in any by a player of the defending team. The player of the attacking side who last played the ball will be credited with the goal but no assist is to be awarded. If an attacking player kicks the ball and is deflected into the net by any player of the defending side, except the goaltender, the goal will be allowed. The player who kicked the ball will be credited with the goal, but no assist is to be awarded. If the ball has been deflected into the goal by a shot of an attacking player by striking any player on the same side, a goal will be allowed. The player who deflected the ball is to be credited with the goal. The goal will not be allowed if the ball has been kicked, thrown, or otherwise deliberately directed into the goal by any means other than a stick. Any goal scored other than as covered by the official rules will not be allowed. When a player scores a goal, an assist will be credited to the player or players who made the pass leading to a direct goal.

When a regular season game is tied at the end of regulation, a sudden death shoot-out would be implemented. There would be a one minute intermission period before the start of the shoot-out. Five players from each team will then attempt to score using a penalty shot format. Players from each team will alternate, with the visiting team having the first attempt.

The following sections describe various rules associated with a rollercross-type game.

SECTION I—THE PLAYING SURFACE

RULE 1—PLAYING SURFACE

The rollercross-type game shall be played on an area known as "THE BOWL". The roller-cross type game can be played on a regular inline hockey rink.

RULE 2—DIMENSIONS OF "THE BOWL"

The rollercross BOWL can fit inside any regulation size ice or inline rink. A minimum of 170 feet×65 feet or a maximum of 200 feet×85 feet. The ramped walls start approximately six feet in from your traditional hockey boards.

RULE 3—GOAL POSTS AND NETS a) Twenty-four feet from each end of the rink and in the center of a red line two inches wide, drawn completely across the width of the playing surface and continued vertically up the side boards, regulation goal posts and nets shall be set in such a manner as to remain stationary during the progress of the game. The goal posts shall be kept in a position in such a fashion to allow the net to move if it should be struck by a player or number of players.

b) The goal posts shall be approved design and material extending vertically four feet above the playing surface and six feet apart (measured form the inside of the posts). A cross bar of the same material as the goal posts shall extend from the top of one post to the other.

c) There shall be attached to each goal, a net of approved design made of white nylon cord, which will be draped in such a manner as to prevent the ball from penetrating through the net.

d) The goal post and cross bar will be painted in red.

e) The red line (two inches wide) between the goal posts on the playing surface and extending across the playing surface shall be referred to as the "goal line".

RULE 4—DIVISION OF PLAYING SURFACE a) The playing surface shall be divided in half by a line twelve inches in width, red in color extending completely across the playing surface and continued vertically up the boards.

b) That portion of the playing surface in which the goal is situated shall be called the "defending zone". The area across from the center red line will be known as the "attacking zone".

RULE 5—CENTER FACE OFF SPOT a) A spot (10–12 inches in diameter) should be marked in the center of the playing surface.

RULE 6—PLAYERS BENCH a) Each facility shall provide an area outside of the playing surface for the players of both teams to use. The accommodations provided (including benches and doors) shall be uniform for both teams. Seats or benches should be able to accommodate a minimum of ten (10) players and shall be placed directly along the side of the playing surface as near as possible to the center red line.

b) Only players in uniform, manager, coaching staff (maximum of two), equipment manager and trainer shall be allowed on the bench.

c) Team will remain on the same bench for the entire game.

RULE 7—PENALTY BENCH

Each facility should provide an area with benches or chairs capable of accommodating a total of ten (10) persons including the official scorekeeper and penalty time keeper. Separate penalty benches should be provided for each team, and should be on the same side as the scorekeeper's table.

RULE 8—SIGNAL AND TIMING DEVICES a) Each facility should provide a horn or siren for the use of the time keeper.

b) Each facility should provide some form of electrical clock. The device should be situated in such a position to allow the spectators, players, officials and coaching staffs to be informed of playing time and penalty time remaining.

c) The clock should run down from time remaining in game and time remaining in penalties.

SECTION II—TEAMS

RULE 9—TEAM COMPOSITION a) Each team shall have a playing roster of a minimum of six (6) and a maximum of twelve (12) players suited for each game.

b) The game will commence with one goaltender and five players on the playing surface for each team. All players for each team should be dressed uniformly in conformity with approved design and specifications.

c) Automatic minor penalty will be issued to the team whose starting lineup does not correspond with that appearing on the official lineup card. Infraction must be reported at the first stoppage of play by the opposing team.

RULE 10—CAPTAIN a) One Captain shall be appointed by each team and he/she alone shall have the privilege of discussing with Referee any questions relating to interpretation of the rules. The Captain may only speak with the Referee when requested to do so by the Referee. The Captaincy does not give license to question judgment calls. The Captain shall be designated with a 3-inch letter "C" appearing on the left front shoulder of his/her jersey.

b) Captains' Circle/Referee Circle—Area near Timekeeper

RULE 11—PLAYERS IN UNIFORM/STARTING LINE UP a) The coach or manager shall list the player's on the official score sheet prior to the beginning of the game.

b) A list of names and numbers of players to partake in the game must be given to the official scorekeeper prior to the beginning of the game. No change will be permitted to the list after the commencement of the game.

c) Each team shall be allowed one (1) goaltender on the floor at one time. The goaltender may be removed and substituted for another player.

d) If a team has a substitute goaltender, he/she must be fully dressed and ready to play in the event a substitute goaltender is required. The substitute goaltender may enter the game only at a stoppage of play.

e) No player on the playing roster shall be permitted to wear the equipment of the goaltender except when the team's goaltenders are incapable of playing due to injury or removal from the game.

f) In the event that the goaltenders are incapacitated, that team shall be entitled to play any available goaltender who is eligible.

RULE 12—SUBSTITUTION OF PLAYERS a) Players from the playing surface may be substituted at any time, however, the player leaving the playing surface must be within five (5) feet of the bench before the substitute may enter the playing surface.

b) When a goaltender leaves the playing surface for the purpose of adding another player and the substitute enters the playing surface before the goaltender is within five (5) feet, the trailing official will immediately blow his whistle and a face-off will be conducted in the defensive zone of the offending team.

c) If by reason of a lack of playing time remaining or by reason of penalties already imposed, a bench minor penalty is imposed for deliberate illegal substitution which cannot be served in its entirety within the legal playing time, a penalty shot shall be awarded against the offending team.

d) A player serving a penalty in the penalty box who is to be substituted by a player on the players' bench, must proceed at once by way of the playing surface directly to the players' bench. Should this rule be violated, a minor penalty will be imposed on the offending team.

e) Following a stoppage of play, the visiting team shall immediately place a line-up on the playing surface. No substitute will be allowed from that time until play has resumed. The home team may then make any desired substitution which does not result in the delay of the game.

f) Should there be any undue delay by either in changing lines, the Referee shall order the offending team/teams to take their positions immediately and not permit a line change.

RULE 13—INJURED PLAYERS a) When a player other than a goaltender is injured or compelled to leave the playing surface, he/she may retire from the game and be replaced by a substitute, but play must continue immediately.

b) If a goaltender sustains an injury or becomes ill, he/she must be ready to resume play immediately or be replaced by a substitute goaltender. No additional time shall be allowed by the Referee for the purpose of enabling the injured or ill goaltender to resume his/her position. The substitute goaltender shall not be allowed a warm-up.

c) When a substitution for the regular goaltender has been made, the regular goaltender shall not resume his/her position until the first stoppage of play thereafter.

d) If a penalized player is injured, he/she may proceed to the dressing room without the necessity of taking a seat on the bench. If the injured player receives a penalty, the offending team shall immediately put a substitute player in the penalty box to serve the penalty. No other replacement for the penalized player shall be permitted to enter the game except from the penalty bench. For violations of this rule, a bench minor penalty shall be imposed.

e) The penalized player who has been injured and replaced on the penalty bench shall not be eligible to play until the penalty has expired.

f) When a player is injured and cannot continue play or go to his/her bench, the play shall continue until his/her team gains possession of the ball unless they are in a scoring position.

g) A player, other than the goalkeeper, whose injury appears serious enough to warrant a stoppage of play, may not participate further in the game until the completion of the ensuing face-off.

SECTION III—EQUIPMENT

RULE 14—STICKS a) The stick shall be made of wood or other material approved by a ruling committee.

b) In the event that a player scores on a penalty shot while using an illegal stick, the goal will be disallowed. No further penalty imposed, however, if no goal is scored, the player taking the penalty shot will receive a minor penalty.

RULE 15—SKATES

Player's are allowed to wear 3, 4 or 5 wheel in-line skates. Skates should have flush mounted bolts.

RULE 16—GOALIE EQUIPMENT a) With the exception of skates and sticks, all equipment worn by the goaltender must be constructed solely for the purpose of protecting the ehad or body. No garment giving goaltender undue assistance in goal keeping shall be worn.

b) The leg guards worn by the goaltender shall not exceed twelve (12) inches in extreme width when on the leg of the player.

c) HECC approved protective masks of a design approved by the ruling committee.

d) Protective padding attached to the back, or forming part of, the goalkeeper's gloves will not exceed 8 inches in width nor 16 inches in length at any point.

e) The goalkeeper may wear 5-wheel skates.

f) Abdominal aprons extending down the thighs or the outside of the pants are prohibited.

g) Violation of the goaltender equipment rule will result in a mnor penalty and the removal of the goaltender from the game until the equipment in question is adjusted to meet the ruling committee specifications.

RULE 17—PROTECTIVE EQUIPMENT

It is rquired that all players wear the following equipment approved by the Commissioner:

1. HECC approved helmete
2. Full Face Cage or Shield (mandatory if under 18 years of age—recommended for adults)
3. Mouth guard (mandatory if under 18 years of age recommended for adults)
4. Elbow Pads
5. Shin Guards
6. Gloves
7. Cup Protector or Pelvic Protector Recommended Equipment:

1. Girdles (mandatory in checking leagues)
2. Shoulder Pads (mandatory in checking leagues)

NOTE: Alteration of approved equipment makes equipment illegal.

RULE 18—DANGEROUS EQUIPMENT

The use of pads or protectors made of metal or any other material likely to cause injury to a player is prohibited.

RULE 19—BALL

A ball is recommended for play in all rollercross-type games.

SECTION IV—PENALTIES

RULE 20—PENALTIES

Penalties shall be either running time or stop time and divided into the following classes:

| | | Running time/Stop time |
|---|---|---|
| 1. | Minor Penalties | 2 min/1 min. 30 sec. |
| 2. | Bench Minor Penalties | 2 min/1 min. 30 sec. |
| 3. | Double Minor Penalties | 4 min/3 min. |
| 4. | Major Penalties | 5 min/4 min. |
| 5. | Misconduct Penalties | 10 min. |
| 6. | Match Penalties | |
| 7. | Penalty Shots | |

RULE 21—MINOR PENALTIES a) For a "minor" penalty, any player, other than a goaltender, is to be ruled off the floor for one minute and thirty seconds (1:30). A "double" minor (three minutes) will be called at the referee's discretion when he/she feels that the infraction does not warrant a major penalty. With running time, penalties will be two minutes (2:00) for a minor and four minutes (4:00) for a double minor.

b) A "bench minor" penalty involves the removal of one (1) player of that team for one minute and thiry seconds (1:30). Any player on the team may be designated to serve the penalty by the coach or playing captain.

c) If, while a team is two-men shorthanded and the opposing team scores a gaol, the first of such penalties shall automatically terminate.

d) Coincidental minor penalties to both teams does not cause either side to be shorthanded (i.e. 4 on 4). However, if one team is already shorthnaded, coincidental penalties will not cause a decrease in the number of players on the floor. After coincidnetal penalties, manpower will remain the same (i.e. four on three or three-on two).

e) When a player receives a major and a minor penalty at the same time, the major penalty will be served first.

RULE 22—MAJOR PENALTIES a) All major penalties will cause the offender (except the goaltender) to remain in the penalty box for the entire four (4) minutes. If game is running time, a major will be five minutes (5:00). All major penalties, unless coincidental, will result in a penalty shot against the offending team.

b) "Major" penalties will be assessed for fighting and for any deliberate attempt to injure. Violent and vicious acts for cross checking, slashing, hitting from behind, charging, elbowing, kneeing, butt-ending, spearing, etc., will be considered a "major" penalty. "Major" penalties cause the offending team to be shorthanded for four (4) minutes no matter how many goals are scored. The offending player is ejected from the game.

c) When coincidental major penalties are imposed against players of each team, the penalized players will be ejected.

d) When two players from the same team are assessed penalties at the same stoppage of play, one player a minor and one player a major, the minor penalty will be recorded and served first.

If one player receives a major and a minor penalty at the same stoppage of play, the major penalty will be recorded and served first.

RULE 23—MISCONDUCT PENALTIES a) "Misconduct" penalties to all players, except the goaltender, involve removal for ten (10) minutes from the current game. A substitute player is permitted to immediately replace a player serving a misconduct penalty. A player whose misconduct penalty has expired will remain in the penalty box until the next stoppage of play.

When a player receives a minor and/or major penalty and a misconduct penalty simultaneously, the penalized team will put a substitute player in the penalty box and the player will serve the major penalty and/or minor penalty without substitute.

b) A "game misconduct" penalty involves the suspension of a player for the balance of the game but a substitute is permitted to replace the player.

A Game Misconduct to a player will result in an automatic one-game suspension (immediate next game) and the non-offending team will receive a Penalty Shot.

RULE 24—MATCH PENALTIES a) A "Match" penalty involves the suspension of a player for the balance of the game. A substitute player must be placed on the penalty bench to serve a four (4) minute penalty and may not return onto the floor, regardless if a goal is scored. If game is running time, a match will be five minutes (5:00).

b) For all match penalties, regardless of when imposed, a total of four (4) minutes will be charged against the offending player and a penalty shot assessed against the offending team.

c) A player incurring a match penalty will be investigated by the ruling committee who will have full power to impose any further penalty as may deem fitting.

RULE 25—PENALTY SHOT a) Any infraction of the rules which calls for a "Penalty Shot" will be taken as follows:

The Referee will name the player designated by him/her or selected by the team entitled to take the shot (as appropriate) and will then place the ball on the center face-off spot. The player taking the shot will, on the whistle of the Referee, play the ball from the center face-off spot and will attempt to score on the goaltender. The goaltender must stay in the crease until the Referee sounds the whistle. The player taking the shot must keep the ball in motion towards the opponent's goal line and once it is host the play will be considered complete. No goal can be scored on a rebound of any kind and any time the ball crosses the goal line, the shot will be considered complete.

b) The goaltender may attempt to stop the shot in any manner except by throwing his/her stick or any other object, in which case a goal will be awarded.

c) In cases where a penalty shot has been awarded for illegal entry into the game, for throwing a stick, and for fouling from behind, the Referee will designate the player who has been fouled as the player who takes the penalty shot.

In cases where a penalty shot has been awarded for falling on the ball in the crease, the penalty shot will be taken by a player selected of the non-offending tam from the players on the floor at the time when the foul was committed. Such selection will be reported to the Referee and cannot be changed. If by reason of injury the player designated by the Referee to take the penalty shot is unable to do so, the shot may be taken by a player selected of the non-offending team from the players on the floor when the foul was committed.

d) Should the player to whom the penalty shot has been awarded commit a foul in connection with the same play or circumstances, he/she will be permitted to take the shot before being sent to the penalty bench to serve the penalty.

e) If at the time a penalty shot is awarded and the goaltender of the penalized team has been removed from the floor to substitute another player, the goaltender will be permitted to return to the floor before the penalty shot is taken.

f) If the goal is scored from a penalty shot, the ball will be faced-off at the center spot. If a goal is not scored, the ball will be faced-off at the face-off spot in the zone in which the penalty shot was taken.

g) Should a goal be scored or not from a penalty shot, a further penalty to the offending player will not be applied unless the offense for which the penalty shot was awarded was a major or match penalty, in which case the penalty called will be imposed.

h) The Referee will award the penalty shot immediately after the foul occurs.

i) all players, except the player taking the penalty shot, must go to their respective players' bench.

j) If an opposing player, other than the goaltender, interferes with the player taking the penalty shot, a goal will be automatically awarded.

k) The time required for the taking of a penalty shot will not be included in the regular playing time.

RULE 26—GOALTENDER PENALTIES a) A goaltender will not be sent to the penalty bench for an offense which incurs a minor or major penalty, but instead the penalty will be served by a player to be designated by the coach or playing captain.

b) Should a goaltender incur a misconduct penalty, this penalty will be served by another member of his/her team who was on the floor when the offense was committed and be designated by the coach or playing captain.

c) Should a goaltender incur a game misconduct or match penalty, he/she will be replaced by a member of his/her own team or a regular substitute goaltender who is available. However, any additional penalties specifically called for by the rules covering match penalties will apply, and the offending team will be penalized accordingly. Each additional penalty will be served by another member of the team who was on the floor at the time of the offense. The player is to be designated by the coach or playing captain.

d) When a goaltender leaves the immediate vicinity of his/her goal crease and takes part in any altercation, he/she will be given a game misconduct penalty.

e) If a goaltender participates in the play in any manner beyond the center line, a minor penalty will be imposed.

RULE 27—DELAYED PENALTIES a) If a third player of any team is penalized while two players of the same team are serving penalties, the penalty time of the third player will not commence until the penalty time of one of the two players already penalized has elapsed. Nevertheless, the third player penalized must proceed to the penalty bench.

b) When the penalties of two players of the same team will expire at the same time, the captain of that team will designate to the referees which player will return to the floor first if a goal is scored.

c) No extra penalty shall be assessed to a team which is shorthanded when a delayed penalty is called and a goal is scored by the team having the power play. The penalized player will be allowed to leave the penalty box. If a goal is not scored the penalty will be assessed.

RULE 28—CALLING OF PENALTIES a) Should an infraction occur and a penalty is to be called on the team in possession of the ball, the Referee is to immediately blow his/her whistle and assess the penalties to the offending player.

b) Should an infraction occur and a penalty is to be called on the team not in possession of the ball, the Referee will signify the calling of a delayed penalty by raising his/her left arm straight above his/her head and point with his/her right hand at the offending player, and on completion of the lay by the team, the Referee will immediately blow his/her whistle and assess the penalty to the offending player.

c) The resulting face-off will be made at the nearest face-off spot to where the play was stopped or at center floor so a not to disadvantage the non-offending team.

d) If the penalty to be imposed is a minor penalty, and a goal is scored on the play by the non-offending team, the minor penalty will not be imposed, but major and match penalties will be imposed in the normal manner regardless of whether a goal is scored or not.

e) If one team is shorthanded and coincidental penalties are called, the numerical strength of players on the floor remains the same.

RULE 29—ABUSE OF OFFICIALS AND OTHER MISCONDUCT a) A game misconduct penalty will be imposed on any player who uses profane or abusive language, persists on disputing a call, or shows disrespect to an official in any manner.

b) Managers, coaches, or other team officials are not allowed to enter the referee's room before, during, or after the contest unless requested to do so by Referee.

c) Teams shall have only one designated Captain and he/she is the only team member allowed to ask for clarification or interpretation from a referee. Other players will be issued a minor penalty for delay of game. Should the Captain be unable to confer with the official because of injury, equipment repair, or being in the penalty box, one designated Captain will be allowed to confer with the official. The designated replacement Captain will not wear a "C", or an "A" on his jersey, but will be noted on the score sheet. Once the Captain or his/her designated Captain enters the playing surface to confer with the official, he/she must remain on the floor for the beginning of the ensuing face-off.

RULE 30—ATTEMPT TO INJURE

A match penalty will be imposed on any player who deliberately attempts to injure an opponent, official, coach, or trainer in any manner, and the circumstance will be reported to the Referee-in-Chief for future action. A substitute for the penalized player will be permitted at the end of the four (4) minutes [see Rule 24(*a*), 24(*b*) and 24(*c*)].

RULE 31—BOARDING

A minor or major penalty, at the discretion of the Referee, will be imposed on any player who violently body checks, cross checks, elbows, charges or trips an opponent in such a manner that caused the opponent to be thrown into the wall.

RULE 32—BROKEN STICK a) A player whose stick is broken may participate in the game provided he immediately drops the broken stick. A minor penalty will be imposed for an infraction of this rule. A broken stick is one which, in the opinion of the Referee, is unfit for normal play.

b) A player or goaltender whose stick is broken may not receive a stick thrown onto the floor from anywhere off the rink, but may obtain one from the bench or from a teammate that is on the rink. A minor penalty plus is misconduct penalty will be assessed for violation of this rule.

c) A goaltender will be allowed to play with a broken stick.

RULE 33—CHARGING a) A minor or major penalty, at the discretion of the Referee will be imposed on a player who violently runs, jumps into or charges an opponent, or blind sides an opponent from behind.

b) A minor or major penalty, at the discretion of the Referee, will be imposed on a player who violently charges or makes unnecessary contact with a goaltender within or outside the goal crease.

RULE 34—CROSS CHECKING AND BUTT-ENDING a) A minor or major penalty, at the discretion of the Referee, is to be imposed on a player who cross checks or butt-ends an opponent.

b) A match penalty will be imposed on any player who deliberately injures an opponent by cross checking or butt-ending.

RULE 35—DELIBERATE INJURY OF OPPONENTS a) A match penalty will be imposed on a player who deliberately injures an opponent in any manner.

b) No substitute will be permitted to take the place of the penalized player until four (4) minutes are up.

c) All such instances will be reported to the ruling committee.

RULE 36—DELAYING THE GAME a) A minor penalty will be imposed on any player, goaltender, or coach who delays the game by deliberately shooting or batting the ball outside the playing surface, deliberately displaces the goal post from normal position, or refuses to place the correct number of players on the floor to commence play after being warned by the Referee.

b) Intentional delay of the game by goaltenders will be called at the discretion of the Referee.

RULE 37—ELBOWING a) A minor penalty will be imposed on any player who uses his/her elbow in such a manner as to foul an opponent.

b) A major penalty will be imposed on a player who injures an opponent as the result of a foul committed by using his/her elbow.

RULE 38—FALLING ON BALL (DELAY OF GAME)

a) A minor penalty will be imposed on a player, other than a goaltender, who deliberately falls on or gathers a ball into his/her body.

b) A minor penalty will be imposed on a goaltender who—when his/her body is entirely outside the boundaries of his/her own crease area and when the ball is behind the goal line—deliberately falls on, gathers into his/her body, holds or places the ball against any part of the goal or against the boards.

c) No defending layer, except the goaltender, will be permitted to fall on the ball, hold the ball, or gather a ball into the body or hands when the ball is within the goal crease. If an infringement of this rule occurs, play is to be immediately stopped and a penalty shot is to be called against the offending team.

RULE 39—FIGHTING a) A major penalty is to be imposed on any player who is involved in a fight.

b) A minor or a double minor penalty is to be imposed on a player who, having been struck, retaliates with a blow or an attempted blow. However, at the discretion of the Referee, a major penalty may be imposed if that player continues the altercation. The referees are provided very wide latitude in the penalties which may be imposed under this rule.

c) A game misconduct penalty will be imposed on any player or goaltender on the floor who intervenes in an altercation already in progress.

d) In all cases, fighting participants will receive a game misconduct, one-game suspensions, and will have their infraction reviewed by the ruling committee for possible supplemental discipline.

e) Instigator receives an additional one minute and thirty second (1:30) penalty, and penalty shot will be charged against his/her team. A replacement player must serve this one minute and thirty second penalty. If a goal is scored on the penalty shot, the penalty is waived.

f) The fighters will be suspended for the next scheduled game.

g) Fighting involving two willing combatants (both to be considered instigators for the purpose of suspensions) will not cause the teams to play shorthanded. Both penalty shots are waived. The fighters will be suspended for the next game. Fighters will be ejected from the game (game misconduct).

RULE 40—GROSS MISCONDUCT a) The Referee may suspend from the game any player, manager, coach, or trainer guilty of gross misconduct of any kind and report the incident to The ruling committee.

b) If the player is taking part in the game and is to be charged with a game misconduct penalty, a substitute will be permitted.

RULE 41—HANDLING BALL WITH HANDS a) If a player, except the goaltender, closes his/her hand intentionally on the ball, the play will be stopped and a minor penalty will be imposed.

b) A player will be permitted to stop or bat a ball in the air with an open hand, or push it along the floor with his/her hand. The play will not be stopped unless, in the opinion of the Referee, the player has deliberately directed the ball to a teammate, in which case the play is to be stopped and the ball faced-off at the nearest face-off spot toward the center line.

c) Hand passes will be permitted only in the defensive zone.

RULE 42—HIP CHECKING

A minor, double minor or major penalty will be imposed on a player who uses his/her hip to deliver a check to an opposing player. No checking below the waist will be allowed.

RULE 43—HOLDING

A minor penalty will be imposed on a player who holds an opponent with his/her hands, stick, or in any other way.

Holding penalty will be called whenever a player deliberately impedes the progress of an opposing player.

RULE 44—HOOKING a) A minor or a major penalty will be imposed on a player who impedes or seeks to impede the progress of an opponent by hooking with his stick.

b) When a player is checking another player in such a way that there is only stick-to-stick contact, such action is not either hooking or holding. He may turn the stick down over the opponent's stick.

RULE 45—INTERFERENCE a) A minor penalty is to be imposed on a player who interferes with or impedes the progress of an opponent who is not is possession of the ball, deliberately knocks a stick out of an opponent's hand, or prevents a player who has dropped his/her stick from regaining possession of it.

b) A minor penalty will be imposed if any player on the player or penalty benches, who by means of his/her stick or body, interferes with the movements of the ball or an opponent on the floor during the progress of play.

c) A minor penalty is to be imposed on a player who, by means of his/her stick or body, interferes with or impedes the movements of the goaltender while he/she is in his/her goal crease area.

d) Unless the ball is in the Goal crease area, a player of the attacking side not in possession may not stand on the goal crease line, in the goal crease, or hold his/her stick in the goal crease area. If the ball should enter the net while such a condition prevails, a goal will not be allowed, and the ball will be faced-off at the center spot.

e) If a player of the attacking side has been pushed into the goal crease by an opposing player, and the ball should enter the net, the goal will be allowed.

f) If, when the goaltender has been pulled, and any member of his/her team is illegally on the floor and interferes by means of his/her body, stick, or any other object with the movements of the ball or an opposing player, the referees are to immediately award a goal to the non-offending team.

RULE 46—KICKING

A match penalty will be imposed on any player who kicks or attempts to kick another player, but a substitute will be permitted at the end of four (4) minutes. A referee's report describing the incident shall be sent immediately after the contest to the Commissioner for review and possible supplemental discipline.

RULE 47—LEAVING PLAYER OR PENALTY BENCHES a) No player may leave the player or penalty benches at any time to enter an altercation. A game misconduct penalty is to be imposed on each player violating this rule. The Referee shall report all such infractions to the ruling committee for further penalties to be applied.

b) Except at the end of each quarter, a time-out, or an expiration of a penalty, no player may leave the penalty bench.

c) A penalized player who leaves the penalty bench before his/her penalty has expired, whether play is in progress or not, will receive an additional minor penalty to be served after serving the "unexpired" penalty.

d) If a player of the attacking team is in a position to have no opposition between him/her and the opposing goaltender and is interfered with by a player entering the game illegally, the attacking player will receive a penalty shot. If the opposing team has pulled the goaltender and the player is illegally interfered with in the above manner, the attacking player will be awarded a goal.

e) If a penalized player returns to the floor from the penalty bench before his/her penalty has expired, any goal scored by his/her own team while he/she is illegally on the floor will be disallowed.

RULE 48—MOLESTING OFFICIALS a) Coaches are not allowed to enter the playing surface during regulation play. Coaches who do enter the playing surface are subject to review and possible suspension by the ruling committee for further review and possible suspension (s). The team officials responsible for such incidents are not eligible to return to their team in any capacity until the ruling committee has decided upon a ruling.

b) Any player, coach, or trainer who holds or strikes an official will be automatically suspended from the game and reported to the ruling committee for further penalties/suspension(s).

c) Players, coaches, and trainers are not to use obscene or profane language anywhere in the facility. For violation of this rule, a bench minor penalty will be imposed.

RULE 49—BALL MUST BE KEPT IN MOTION a) The ball must be kept in motion at all times.

b) A minor penalty is to be imposed on any player who deliberately holds the ball against the boards in any manner.

RULE 50—SLASHING a) A minor or major penalty, at the discretion of the referees, will be imposed on any player who impedes or seeks to impede the progress of any opponent by slashing his stick.

b) A major penalty and game misconduct penalty will be imposed on any player who injures an opponent by slashing.

c) Any player who swings his/her stick at another player in the course of any altercation will be subject to a match penalty.

RULE 51—SPEARING

A major penalty will be imposed on a player who spears or attempts to spear an opponent, regardless of whether bodily contact is made or not.

RULE 52—THROWING STICK

If infraction occurs in the defensive zone of the offender, the penalty issued will be a penalty shot. Such an infraction in the offensive zone will carry a one minute and thirty second (1:30) penalty only. If the infraction occurs while the goaltender has been pulled for an extra attacker, a goal will be awarded regardless of which zone the throwing of the stick occurred.

RULE 53—TRIPPING a) A minor penalty will be imposed on any player who places his/her stick, knee, foot, arm, hand, or elbow in such a manner that it causes his/her opponent to trip or fall.

b) When a player is in control of the ball in the attacking zone and has no opponent between him/her and the goaltender, and is tripped or otherwise fouled from behind, thus preventing reasonable scoring opportunity, a penalty shot will be awarded to the player. If, when the opposing team has pulled the goaltender, the above infraction occurs, the attacking team will be awarded a goal.

RULE 54—UNNECESSARY ROUGHNESS (ROUGHING)

a) A minor or major penalty, at all discretion of the Referee, will be imposed on any player who uses unnecessary roughness.

b) The act of riding an opponent off the ball, or meeting the opponent head-on while attempting to play the ball, will not be considered roughing.

c) Penalty for unnecessary roughness should be called in every case when an opposing player makes unnecessary contact with the player in possession.

RULE 55—CHECKING FROM BEHIND a) A minor penalty, or a major penalty shall be imposed on a player who runs or violently jumps into or charges an opponent (Note: If more than two steps or strides are taken, it shall be considered Charging). When a player injures an opponent as the result of "charging" or "checking from behind," the Referee shall have no alternative but to impose a major plus a game misconduct penalty on the offending player. A game misconduct penalty also includes a penalty shot.

b) A minor penalty or a major penalty shall be imposed on a player who body checks or charges a goaltender while the goaltender is within his/her goal crease or privileged area. A goaltender is not "fair game" just because he/she is outside his/her privileged area. A penalty for interference or charging should be called in every case where an opposing player makes unnecessary contact with a goaltender.

RULE 56—BODY CHECKING (OPTIONAL)

Use of the body to physically make contact with an opposing player will be allowed for ages over 13 years old. An additional minor penalty will be assessed at the discretion of the Referee if in his/he opinion the player used excessive force when checking.

RULE 57—REFEREE a) For the commencement of each game and at the start of each regulation and overtime quarter. The Referee will remain on the floor at the conclusion of each quarter and wait until the players have proceeded to their benches or dressing room. The visiting team must exit the floor first at half-time and at the conclusion of the game.

b) The Referee will check the equipment worn by any player when requested to do so by the coach of either team.

c) The Referee will assess all penalties as described by the rules of this game.

d) The Referee will have the final decision on all goals, disputed or not.

e) Before starting the game, the Referee will see that the appointed Game Time keeper and Official Scorekeeper are in their respective places.

f) The Referee will announce to the official Scorekeeper the duration of the penalties and the rule infractions involved, and also to whom the goals and assists are to be credited.

g) After each game, the Referee will check and sign the score sheet and return it to the Official Scorekeeper.

RULE 58—GOAL JUDGES a) Each Goal Judge must be stationed in the designated area behind the goal for the duration of the game and will not change ends at any time after the game begins. (Optional)

b) The Goal Judge will decide whether or not the ball has passed between the goal posts and entirely over the goal line. His/Her decision will be Goal or No Goal, but his/her decision can be overruled by the referees.

RULE 59—OFFICIAL SCOREKEEPER a) The Official Scorekeeper will enter in the score sheet a correct record of the goals scored, and to whom credit is given for assists. He/She will also keep a correct record of all penalties assessed, the duration of each penalty, the infraction, and the time the penalty was assessed.

b) At the completion of each game, the Official Scorekeeper will sign the score sheet and then have the Referee sign it. He/She will then forward the score sheet to the League Manager.

c) Prior to the start of the game, the Official Scorekeeper will obtain from the manager or coach of each team their complete line up including the starting line up. The visiting team must declare its starting line up first. The captain and alternate captains of each team will be noted.

d) The Official Scorekeeper will submit the complete line up and the starting line up of the competing teams to the referees and to the two head coaches prior to the start of the game.

RULE 60—GAME TIME KEEPER a) The Game Time keeper will record all actual playing time during the game.

b) The Game time keeper should announce when one (1) minute of actual playing time remains in each regulation quarter.

SECTION V—ADDITIONAL RULES

RULE 61—OFF-SIDE

When passing, the ball must precede the player or players over the center line to remain on-side. However, if the ball is carried over the center line, all attacking players are declared on-side. The position of the player's skates and not that of his/her stick will be the deciding factor in determining an off-side violation. (Only for advanced level play silver or above.

RULE 62—INTERFERENCE BY SPECTATORS a) When the ball goes outside the playing area or strikes any obstacles above the playing surface other than the boards or glass, it will be faced-off at nearest face-off spot from where it was shot or deflected.

b) When the ball becomes lodged in the netting on the outside of the goal or if it is frozen between opposing players, the referees will stop play and face-off the ball at the face-off spot in the zone where the stoppage occurred.

c) If the ball comes to rest on top of the boards surrounding the playing area, it will be considered to be in play and may be played legally by the hand or stick.

RULE 64—ADJUSTMENT TO CLOTHING AND EQUIPMENT

Play will not be stopped or delayed by reason of adjustment of clothing, equipment, skates or sticks with the exception of a goaltender.

RULE 65—GOALS AND ASSISTS a) A goal is scored when the ball has been put between the goal posts by the stick of a player of the attacking side from in front, below the cross bar and entirely across the goal line.

b) A goal is scored if the ball is put into the goal in any way by a player of the defending side. The player of the attacking side who last played the ball will be credited with the goal but no assist is to be awarded.

c) If an attacking player kicks the ball and it is deflected into the net by any player of the defending side, except the goaltender, the goal will be allowed. The player who kicked the ball will be credited with the goal but no assist is to be awarded.

d) If the ball has been deflected into the goal by a shot of an attacking player by striking any player of the same side, a goal will be allowed. The player who deflected the ball is to be credited with the goal. The goal will not be allowed if the ball has been kicked, thrown, or otherwise deliberately directed into the goal by any means other than a stick.

e) Any goal scored other than as covered by the official rules will not be allowed.

f) When a player scores a goal, an assist will be credited to the player or players who made the pass leading to a direct goal.

RULE 66—START OF GAME AND QUARTER a) The game will start at the time scheduled by a face-off in the center of the playing surface.

b) The home team will have the choice of goals to defend at the start of the game. The teams will change ends at half-time.

c) During the pre-game warm-up and before each quarter, each team will confine its activity to its own end of the rink.

d) All players must be in full uniform to take the floor for warm-ups.

RULE 67—GAME TIME AND TIME-OUTS a) The game will consist of four twelve (12) minute quarters. The clock will only be stopped during the last two (2) minutes of games that are within two (2) goals or less.

b) For games that are tied at the end of regulation, refer to shoot-out procedures.

c) Each team may have one thirty (30) second time-out per game. Players in the penalty boxes must remain there.

d) A time-out may only be called by a team when the ball has been whistled dead. Play resumes at the nearest face-off spot.

e) When there is a time-out, all players may go to the team's bench.

RULE 68—SHOOT-OUT PROCEDURES AND RULES a) When a regular season game is tied at the end of the game, the teams shall enter a sudden-death shoot-out. The completed game shall be entered as a tie for each team in the league standings. The winner of the shoot-out shall be awarded an additional point in the category entitled "overtime points" which shall count in the overall points in the League Standings.

b) There will be a one (1) minute intermission period before the start of the shoot-out. Five players from each team will then attempt to score using a penalty shot format. Players from each team will alternate, with the visiting team having the first attempt.

c) Teams may change goaltenders at the beginning of the shoot-out or if a goaltender is legitimately injured during the shoot-out. After the first visiting player has attempted to score in the shoot-out, neither goaltender may be changed (except in the case of injury). Goaltenders shall not change creases during the shoot-out.

d) Should neither team have an advantage at the end of the first shoot-out round, a second shoot-out round will result. All eligible dressed skaters from a team shall shoot before that team shall be allowed to have a player shoot the second time in the shoot-out.

e) Goals scored during the shoot-out rounds shall not count in a player's scoring statistics. Goals scored against a goaltender shall not count against the goaltender statistically. A goaltender shall receive either a win or a tie based on the results of the shoot-out.

f) Players who have been ejected from the game or who have time remaining on the penalty clock are not eligible to participate in the shoot-out.

g) Both teams must be at their respective benches with no interference to players taking shot on goal.

h) The Referee will place the ball on the face-off spot at center floor.

i) The Referee will skate directly to and take up position near the goal consistent with calling a goal. A referee will place the ball at the center line.

j) The rules on the penalty shot, where applicable, will also apply to the shoot-out (i.e. interference, throwing stick, etc.).

k) Any players who have time remaining on a penalty when the overtime period ends, must go directly to and remain in their respective team locker room during the shoot-out period.

l) Any player or coach who has been previously ejected from this game must still follow the rule for ejection—that being: The player or coach ejected must either go to and remain in his/her respective team's locker room or quietly and directly leave the building following his/her ejection from the game.

The above rules of the rollercross-type game described in this application are to be used as a guideline. Various rules can be changed depending upon particular circumstances and are not meant to be overly restrictive.

What is claimed is:

1. A game apparatus to be played on a rink provided with a planar playing surface surrounded by a ramped playing surface which in turn is surrounded by an elevated platform surface, with a goal provided near each of the two longitudinal ends of the planar playing surface, the game conducted by two teams, each team consisting of a like number of players, comprising:

a ball;

a plurality of playing sticks, each of the players carrying one of said sticks, each of said sticks provided with an elongated handle and a netted pocket attached to said handle for the purpose for catching and throwing said ball with the ultimate aim of propelling said ball into one of the goals; and a plurality of pairs of inline roller skates, each of said pairs of skates to be worn by one of the player during the course of the game.

2. A game apparatus to be used by two teams consisting of a like number of players comprising:

a planar playing surface defined by two parallel end lines and two parallel side lines;

a ramped playing surface surrounding said planar playing surface;

an elevated platform surface surrounding said ramped playing surface;

a goal provided close to each end of said planar playing surface;

a ball;

a plurality of playing sticks, each of the players carrying one of said sticks, each of said sticks provided with an elongated handle and a netted pocket attached to said handle for the purpose for catching and throwing said ball with the ultimate aim of propelling said ball into one of the goals; and a plurality of pairs of inline roller skates, each of said pairs of skates to be worn by one of the player during the course of the game.

3. The game apparatus in accordance with claim 2, wherein said ramped playing surface completely surrounds said planar playing surface.

4. The game apparatus in accordance with claim 3, wherein said elevated platform surface completely surrounds said ramped playing surface.

5. The game apparatus in accordance with claim 2, further including a wall surrounding said elevated platform surface.

6. The game apparatus in accordance with claim 5, wherein said wall comprises a first lower section and a second transparent upper portion.

7. A method of playing a game between two teams consisting of a like number of players on a planar playing surface defined by two parallel end lines and two parallel side lines, a ramped playing surface surrounding the planar playing surface and an elevated platform surface surrounding the ramped playing surface comprising:

outfitting each of the players with inline roller skates;

providing each of the players with a stick having an elongated handle attached to a netted pocket for the purpose of catching and throwing a ball with the ultimate aim of propelling the ball into one of two goals each of which is situated near opposite ends of the planar playing surface.

8. The method in accordance with claim 7 with the additional step of allowing each of the players to skate on the ramped playing surface as well as the elevated platform surface.

9. The game in accordance with claim 7 further including the step of allowing the ball to be rolled between players on the same team.

10. The game in accordance with claim 8 further including the step of allowing the ball to be rolled between players on the same team.

* * * * *